US006644606B1

(12) United States Patent
Seidel

(10) Patent No.: US 6,644,606 B1
(45) Date of Patent: Nov. 11, 2003

(54) MOUNTING SUPPORT BRACKET FOR AN ADVERTISING WINDUP REEL

(76) Inventor: Gregg A. Seidel, 873 9th St., Manhattan Beach, CA (US) 90266

( * ) Notice: Subject to any disclaimer, the term of this patent is extended or adjusted under 35 U.S.C. 154(b) by 189 days.

(21) Appl. No.: 09/605,391

(22) Filed: Jun. 29, 2000

(51) Int. Cl.[7] ..... A47G 29/00; G09F 11/18

(52) U.S. Cl. ..... 248/220.41; 248/222.12; 248/313; 40/514

(58) Field of Search ..... 248/220.41, 222.12, 248/313, 316.1, 316.7; 40/515, 517, 514; D20/43, 211; D19/76

(56) References Cited

U.S. PATENT DOCUMENTS

| | | | | | |
|---|---|---|---|---|---|
| 1,065,295 | A | | 6/1913 | Connors | 40/517 |
| 1,364,223 | A | | 1/1921 | Venard | 40/517 |
| 1,570,104 | A | | 1/1926 | Vancil | 40/517 |
| 1,590,862 | A | | 6/1926 | Seaquist | 40/517 |
| 1,728,649 | A | | 9/1929 | Winter | 40/517 |
| 4,525,946 | A | | 7/1985 | Olson | 40/514 |
| D306,878 | S | * | 3/1990 | Crowley | D20/43 |
| D322,287 | S | | 12/1991 | Sukman | D20/43 |
| 5,097,611 | A | | 3/1992 | Smollar et al. | 40/514 |
| D350,568 | S | | 9/1994 | Lucarelli | D20/43 |
| 5,494,250 | A | * | 2/1996 | Chen | 248/316.7 |
| 5,791,080 | A | * | 8/1998 | Hamano | 40/642.02 |
| 5,966,854 | A | * | 10/1999 | Walsh et al. | 40/514 |
| 6,038,800 | A | | 3/2000 | Seidel | 40/517 |
| D424,121 | S | * | 5/2000 | Kump | D20/43 |
| D426,584 | S | * | 6/2000 | Czalkiewicz | D20/43 |
| 6,082,687 | A | * | 7/2000 | Kump et al. | 211/57.1 |
| 6,108,956 | A | * | 8/2000 | Conway et al. | 40/651 |
| 6,176,028 | B1 | * | 1/2001 | Walsh et al. | 40/514 |
| 6,341,755 | B1 | * | 1/2002 | Kump | 248/220.41 |
| 6,354,546 | B1 | * | 3/2002 | Mueller | 248/220.41 |
| 2002/0050083 | A1 | * | 5/2002 | Zarelius | 40/514 |

FOREIGN PATENT DOCUMENTS

| | | |
|---|---|---|
| GB | 316636 | 7/1929 |

* cited by examiner

*Primary Examiner*—Leslie A. Braun
*Assistant Examiner*—Naschica S. Morrison
(74) *Attorney, Agent, or Firm*—Jack C. Mumro

(57) ABSTRACT

A mounting support bracket for an advertising windup reel which comprises a base which is to be fixedly secured to an exterior surface. Mounted on the base are a pair of hook members and a depending tab with the outer end of the depending tab having an elongated ridge and groove. A portion of an advertising windup reel is to be connectable between the groove and the hook members to be clamped therebetween thereby fixing in position the advertising windup reel to the mounting support bracket. The depending tab includes a handle which facilitates manual movement of such to deflect the depending tab and permit disengagement of the windup reel housing.

2 Claims, 3 Drawing Sheets

MOUNTING SUPPORT BRACKET FOR AN ADVERTISING WINDUP REEL

BACKGROUND OF THE INVENTION

1) Field of the Invention

The field of this invention relates to brackets and more particularly to a bracket for an advertising windup reel which is to be mounted on the forward surface of an article supporting shelf that is commonly located within retail stores.

2) Description of the Prior Art

Typical self service retail stores, such as drug stores, supermarkets, computer software stores, liquor stores and the like, have rows of multiple tier shelves which are used to support products for sale. The product, or the exterior package of the product, is visually displayed on the shelf. Generally, there are many units of a particular product stocked on that shelf. The consumer would normally select a product from the shelf without the assistance of a clerk. Therefore, the shelf also performs a dispensing function.

It is common for product manufacturers and distributors to want to include a display advertisement at the shelf location for a particular product. While a product is readily visible on a shelf, the mere presence of the product, because the product is displayed with numerous other products on the shelf, may be insufficient to stimulate consumer interest. Shelf space in a store is a valuable commodity. The amount of shelf space assigned to each product is at the minimum. A given product can become "lost" on a shelf amongst all the other products. Also, the product may be enclosed in a small package so that there is no large "advertising" space or advertising surface to catch the consumer's eye or the available space on the package may be insufficient to contain all the information that a manufacturer or retailer wishes to depart to a potential purchaser. Additionally, the product may be packaged in a plain wrapper or, in the case of produce, no packaging at all. There also may be involved some kind of specialty promotion with a product that is not included on the package since the promotion may only run for a short period of time.

Manufacturers and retailers are becoming aware that shelf advertising can be an exceedingly effective way in which to sell goods. Not only can the advertising motivate a consumer's purchase, but it can also be informative to the consumer about the product. Shelf advertising is limited as to the available space. The only convenient location for shelf advertising is at the front edge of the shelf which is short in length, usually no more than four to ten inches in length, and only occupies an inch to an inch and one half in height. However, if some form of device could be mounted on the front edge of the shelf and the device constructed in a manner to be expandable to a larger area so that additional information can be printed on the larger area and then made available to the consumer only when the consumer is interested in obtaining that information, then such an advertising device would be most desirable. Also, when the consumer is not utilizing the device, the device assumes a retracted state occupying a minimal amount of space when it is not used.

In the past, it has been known to mount a scroll type of device on the front end of the shelf where the scroll can be unwound to display advertising or information about a product, and then when released by the consumer, the device retracts to a small size, at-rest position. Such scrolls are commonly referred to as windup reels. In the past, these windup reels have been fixedly mounted onto the front end of the store shelf. It would be desirable to include some kind of mounting arrangement so that the windup reel could be easily removed from the shelf if such is not needed. Possibly the windup reel could be utilized only for a promotion and once the promotion ends the windup reel then becomes unnecessary. If the windup reel is permanently affixed to the shelf, removal of that windup reel is difficult.

Additionally, the scroll within the windup reel may need to be changed such as would be required at the end of a certain promotion of a product. To facilitate this changing, it is generally necessary to remove the windup reel from the shelf, move such to a work area, and then the windup reel disassembled and the scroll removed and replaced. The windup reel then needs to be reinstalled back in position in the front end of the shelf. It would be desirable to utilize some type of device to facilitate quick and easy attachment of the windup reel onto the shelf.

Windup reels in conjunction with store shelves have proved to be quite desirable because such occupy a minimal amount of space and protrude only a slight distance forward of the shelf. In the past, one way to include advertising at the front end of the shelf is to mount a free standing sign which extends outward from the shelf. However, such free standing shelves protrude into the aisle area which is used for passage of the consumers with the result that such signs are frequently struck by the consumers and knocked free of the shelf therefore becoming ineffective. Also, the usage of such free standing signs generally obscure the shelves making it somewhat difficult for the consumer to visually find a particular product that a consumer wishes to purchase. Also, such free standing signs have to be quite small in size therefore being very limited to the amount of information or advertising that could be placed thereon. Therefore, the use of a scroll within a windup reel is a far more desirable advertising device than a free standing sign.

SUMMARY OF THE INVENTION

The structure of the present invention relates to a mounting support bracket for a scroll type of advertising windup reel which facilitates quick and easy mounting of such onto the front end of an article supporting shelf in a store and also facilitates quick and easy removal of the windup reel from its mounted location. The mounting support bracket comprises a base which is to be fixedly fastened to the horizontal portion of the shelf. The depending tab is integrally secured to the base and is to extend away from the base and be located along the front end of the article supporting shelf. The base also includes a pair of hook members. The windup reel is to be clamped between the hook members and the outer end of the depending tab. The depending tab is to be manually deflectable to as to facilitate engagement and disengagement of the windup reel.

The primary objective of the present invention is to construct a mounting support bracket for an advertising windup reel that facilitates quick and easy attachment and detachment of the windup reel relative to the bracket.

Another objective of the present invention is to construct a mounting support bracket which can be quickly and easily installed in a fixed position on an article supporting shelf of a retail store.

Another objective of the present invention is to construct a mounting support bracket which is simple in construction and can be manufactured at low cost and therefore sold to the ultimate consumer at a low cost.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE PREFERRED EMBODIMENT

Figure 1:
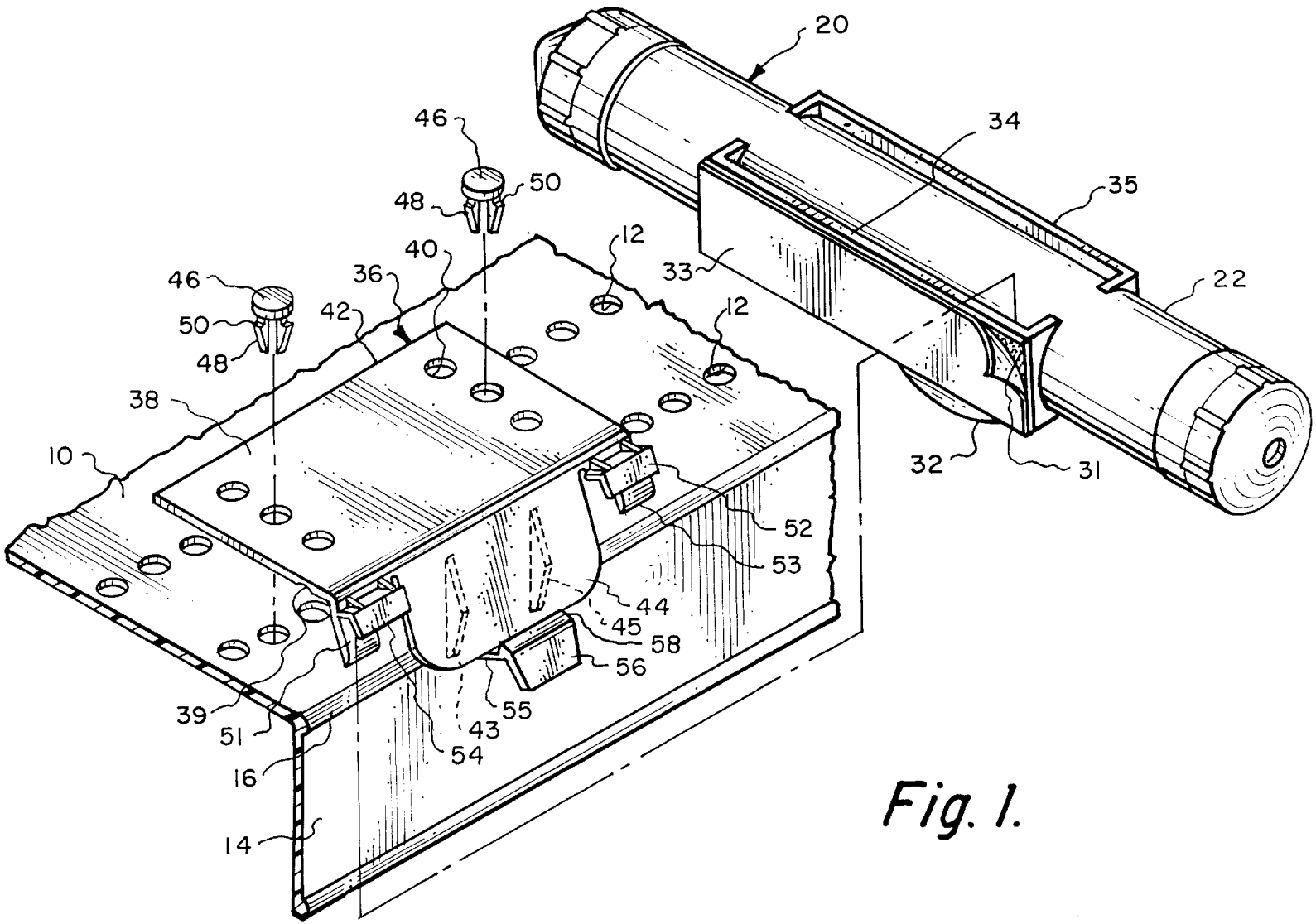
FIG. 1 is an exploded isometric view showing the arrangement between the mounting support bracket and the shelf on which it is mounted and the windup reel which is to be supported by the mounting support bracket.

Referring particularly to the drawings, there is shown a planer horizontally located article supporting shelf 10 that has formed therein two rows of a series of holes 12. The holes 12 are normally all of the same size and generally about one-quarter of an inch in diameter. The shelf 10 has a front edge 14 that is located basically vertical. At the joint between the shelf 10 and the front edge 14 is located an elongated bead 16. It is to be understood that the shelf 10 will be used to support a quantity of a product for sale and the shelf 10 to be located within retail store with it understood within the store there would be a substantial number of shelves 10.

There is also shown in the drawings a windup reel 20 with such a windup reel being disclosed within U.S. Pat. No. 6,038,800 issued to the present inventor. The windup reel 20 includes a windup reel housing 22 which is basically cylindrical in configuration and, in essence, comprises a tube that has an internal chamber 24. Rotationally mounted within the internal chamber 24 is a roller 26. One end of a scroll 28 is fixedly mounted to the roller 26. The scroll 28 comprises flexible sheet material and generally would be constructed of plastic. The outer end of the scroll 28 protrudes exteriorly of the windup reel housing 22 through a longitudinal opening 30. The outer end of the scroll 28 is attached to a handle 32. The handle 32 is to be grasped by a user and pulled in an outward direction which will cause the scroll 28 to unwind and protrude substantially its entire length exteriorly of the windup reel housing 22. This will provide the opportunity for the user to read and otherwise observe the material that is inscribed on the scroll 28. When the user releases the handle 32, the scroll 28 will automatically retract to be completely confined within the internal chamber 24.

Mounted on the windup reel housing 22 is a plate 34. The plate 34 is mounted on the housing 22 at a position substantially diametrically opposite the longitudinal opening 30. There is also a plate 35 mounted on the housing 22 diametrically opposite plate 34. Plate 35 is for the purpose of signage so the potential purchaser will be informed of the name of the product to which the windup reel housing 22 applies. Plate 34 is for mounting of the windup reel 20 by using an adhesive pad 31 which is covered by a protective cover sheet 33 which is to be removed to expose the adhesive pad 31.

The mounting support bracket 36 of this invention includes a base in the form of a planar section 38. Formed within the planar section 38 are two rows of holes 40. The holes 40 are all of the same size and are generally about the same size as the holes 12. Each row of the holes 40 is three in number with one row of the holes 40 being located directly adjacent the left edge of the planar section 38 with the other row of the holes 40 being located directly adjacent the right edge of the planar section 38. One hole 40 of each row is to be aligned with a respective hole 12. If the holes 40 are used that are located closest to the back edge 42 of the planar section 38, then the depending tab 44 will be located in a furthest spaced relationship from the front edge 14. If the pair of holes 40 that are located closest to the depending tab 44 are aligned with their respective pair of holes 12, then the depending tab 44 will be located closest to the front edge 14. The selection of which pair of holes 40 are to be used is strictly according to the desires of the user.

Once the desired pair of holes 40 are selected, a user utilizes a fastener 46 which is to be press fitted within each of the holes 40 that are being used. The fastener 46 is to contract when being inserted through the selected hole 40 and then through the selected hole 12 and when it is completely inserted, the body of the fastener 46, which is composed of four in number of legs 48, then expand capturing the portion of the shelf 10 and the planar section 38 surrounding the holes 12 and 40 within an annular groove 50 of each of the fasteners 46. Therefor the planar section 38 is now fixedly mounted to the shelf 10.

The depending tab 44 is integrally connected to the planar section 38. Depending tab 44 extends transversely from planar section 38 to alongside front edge 14 of shelf 10. Integrally connected to the planar section 38 and located directly adjacent the left edge of the depending tab 44 is a hook member 54. A tab 51 extends parallel to depending tab 44 but is not movable like depending tab 44. Tab 51 is about one-half the length of depending tab 44. The tab 51 is to provide back support for the plate 34 when captured by the hook member 54. A similar hook member 52 is integrally connected to the planar section 38 and is located just off the right edge of the depending tab 44. Associated with hook member 52 is a tab 53 which is basically similar to tab 51 and works with hook member 52 in the same manner. The outer end of the depending tab 44 includes a right angled ledge 55. The outer end of the right angled ledge 55 is integrally connected to handle 56 which is also mounted at a right angle position relative to the ledge 55. Integrally mounted on the right angled ledge 55 is an elongated ridge 58. Located directly adjacent the ridge 58 and also directly adjacent the handle 56 is an elongated groove 60.

Figure 2:
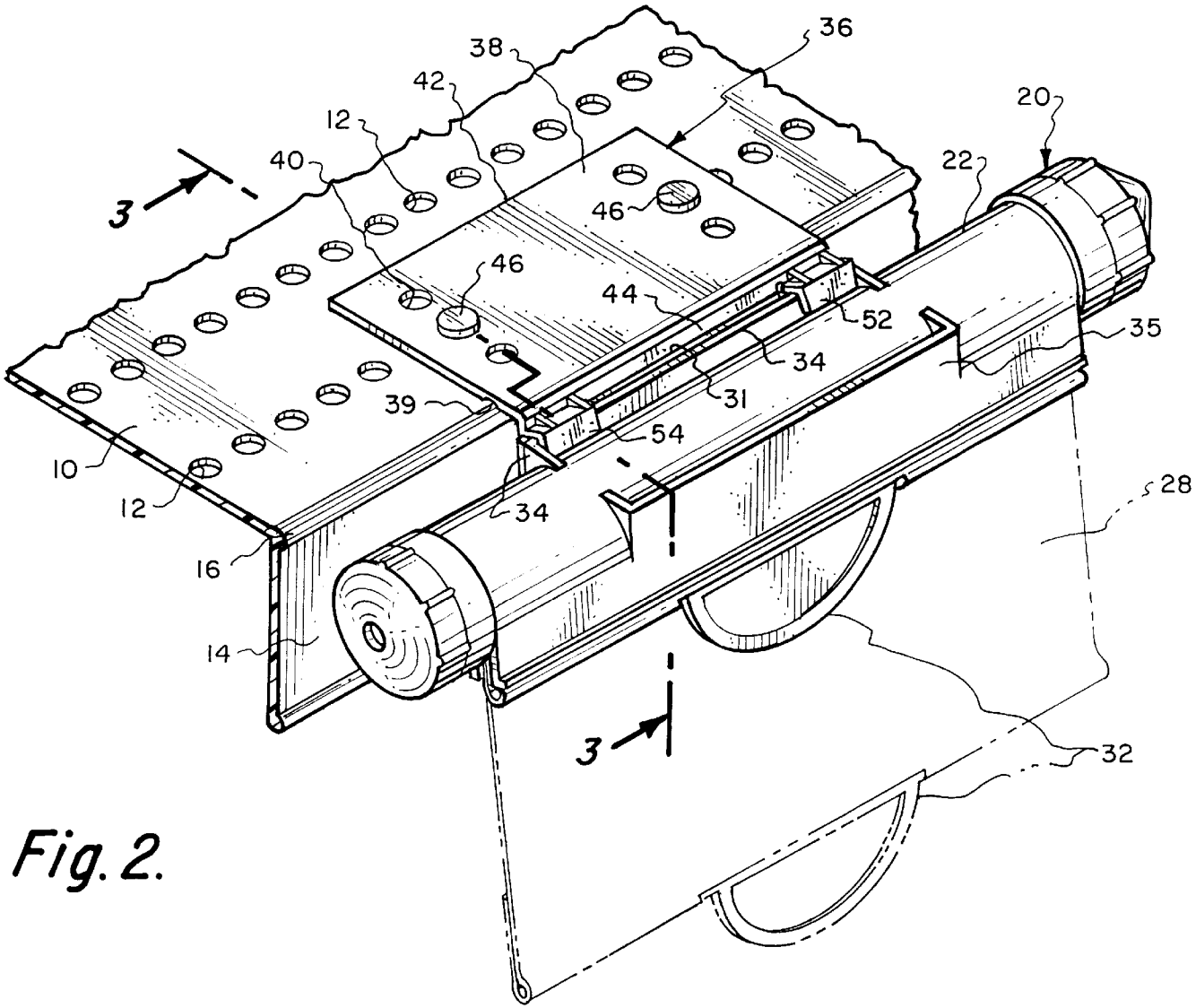
FIG. 2 is an isometric view showing the windup reel being mounted in conjunction with the mounting support bracket.

The installation procedure for the windup reel 20 to the mounting support bracket 36 is as follows: The upper edge of the plate 34 is located underneath the hook members 52 and 54. This locating of the plate 34 underneath the hook members 52 and 54 is shown in the dotted line position 62 of FIG. 3. The user then pivots the windup reel 20 so that the lower edge of the plate 34 comes in contact with the right angled ledge 55 and causes the depending flange 44 to pivot slightly toward the front edge 14 until the lower edge of the plate 34 matingly engages with the elongated groove 60 and abuts against the elongated ridge 58. The windup reel 20 is now fixedly mounted in conjunction with the bracket 36 as is shown in solid lines in FIG. 3, and as is also shown in FIG. 2. The plate 34 will now be located in groove 60 and held there by ridge 58. Prior to this installation of the windup reel 20, the cover sheet 33 is removed and discarded exposing adhesive pad 31. This pad 31 will adhesively bond onto the depending tab 44 to provide for the permanent securement. This will be the normal usage for the windup reel 20 as it is now mounted just forward and spaced from the front edge 14 of the shelf 10.

Figure 3:
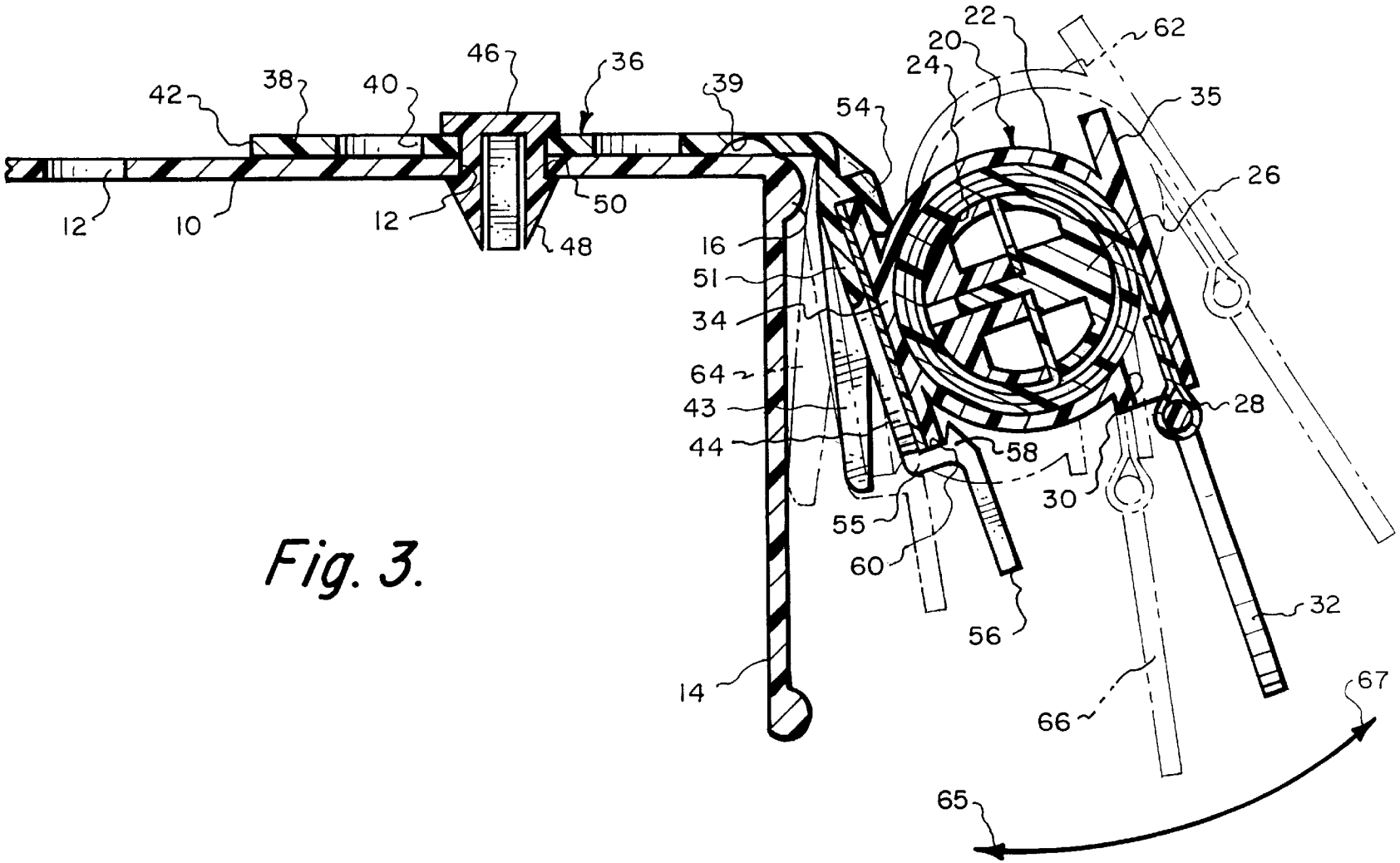
FIG. 3 is a cross-sectional view taken along line 3—3 of FIG. 2 depicting different positions of the mounting support bracket and the windup reel during engagement and disengagement of the windup reel from the mounting support bracket.

Let it now be assumed that the user wishes to disengage the windup reel 20 from the mounting bracket 36. The user applies an inward pushing force against the handle 56 in direction of arrow 65 which causes the depending tab 44 to pivot to the dotted line position 64 shown in FIG. 3 which will actually locate the ribs 43 and 45 against the shelf 14. The ribs 43 and 45 function to limit the amount of inward movement of the depending tab 44. When in this position, the lower edge of the plate 34 will be dislodged from the elongated groove 60 and the handle 32 will be in the dotted line position 66 shown in FIG. 3. The user can then grasp the windup reel 20 and pivot such counterclockwise as shown in FIG. 3, breaking the adhesive securement of pad 31, which will remove the lower edge of the plate 34 from the elongated groove 60, and then by moving in a slight downward direction, the upper edge of the plate 34 can be dislodged from the hook members 52 and 54. The windup reel 20 is now separated from the bracket 36 permitting such to be moved to a separate location for changing of the scroll 28. The depending tab 44 will automatically move in the direction of arrow 67 back to the solid line position shown in FIG. 3.

The user also has the option of moving the windup reel 20 away from the front edge 14 while still attached to the bracket 36. The purpose of this is to make it easier to read the scroll 28 especially if a tall person is using the windup reel 20. Also, by being able to pivot the scroll away from the front edge 14, store personnel can easily access price and/or price code labels that are commonly placed on the front edge. This movement is permitted by the inclusion of an elongated groove 39 totally across the planar section 38 and formed within the surface of the planar section 38 that is in contact with the shelf 10. This groove 39 permits the depending tab 44 to be pivoted relative to the planar section 38. The groove 39 is commonly known as a "living hinge."

The present invention may be embodied in other specific forms without departing from the essential attributes thereof. Reference should be made to the appending claims rather than the foregoing specification as indicating the scope of the invention.

What is claimed is:

1. A mounting support bracket for an advertising windup reel, comprising:

a base, said base having means for facilitating attachment to an exterior surface;

a rigid hook assembly mounted on said base, said hook assembly adapted for engagement to a windup reel housing, said hook assembly comprising a pair of spaced apart hook members;

a depending tab mounted on said base and extending transversely therefrom, said depending tab being mounted between said hook members, said depending tab having a free outer end which includes an engagement device adapted for engagement to the windup reel housing which results in clamping the windup reel housing between said engagement device and said hook assembly thereby fixing and supporting the windup reel housing on said depending tab;

a handle attached to said free outer end, said handle facilitating manual movement of said depending tab in order to engage the windup reel housing with said depending tab;

said depending tab being deflectable so as to be movable between an engaged position to a disengaged position, with said depending tab in said engaged position the windup reel housing is capable of being fixed and supported on said depending tab, with said depending tab in said disengaged position the windup reel housing being disengaged from said depending tab and also movable into engagement with said depending tab; and said engagement device comprises an elongated ridge and a groove for the windup reel housing to connect with said groove when in said engaged position.

2. In combination with an advertising windup reel having a housing, a mounting support bracket for mounting of said advertising windup reel, said mounting support bracket comprising:

a base, said base having means for facilitating attachment to an exterior surface;

a hook assembly mounted on said base, said hook assembly to engage with said windup reel housing;

a depending tab mounted on said base, said depending tab having a free outer end which includes an engagement device for engagement with said windup reel housing which results in clamping of said windup reel housing between said engagement device and said hook assembly thereby fixing and supporting of said windup reel housing on said depending tab;

a handle attached to said free outer end, said handle facilitating manual movement of said depending tab in order to engage said windup reel housing with said base and;

said depending tab having a planar surface which is to be located parallel to said windup reel housing.

* * * * *